United States Patent [19]

Stegelman

[11] 4,102,508

[45] Jul. 25, 1978

[54] YARN SUPPLY PACKAGE AND METHOD AND APPARATUS FOR THE WINDING THEREOF

[75] Inventor: Albert F. Stegelman, Borger, Tex.

[73] Assignee: Phillips Fibers Corporation, Greenville, S.C.

[21] Appl. No.: 810,337

[22] Filed: Jun. 27, 1977

[51] Int. Cl.[2] ..... B65H 54/02; B65H 54/34; B65H 55/00; B65H 55/04

[52] U.S. Cl. ..... 242/18 PW; 242/18 DD; 242/165

[58] Field of Search ..... 242/18 PW, 18 A, 18 DD, 242/164, 165

[56] References Cited

U.S. PATENT DOCUMENTS

| | | | |
|---|---|---|---|
| 2,395,890 | 3/1946 | Lodge | 242/18 PW |
| 2,517,625 | 8/1950 | Bauer et al. | 242/18 PW |
| 3,075,715 | 1/1963 | Hensen et al. | 242/18 PW |
| 3,149,795 | 9/1964 | Rhein, Jr. | 242/18 A |
| 3,717,310 | 2/1973 | Ritter | 242/18 PW X |
| 3,819,123 | 6/1974 | Luz | 242/18 PW |
| 3,870,240 | 3/1975 | Miller | 242/18 PW X |
| 3,971,518 | 7/1976 | Newman et al. | 242/18 PW |
| 3,982,707 | 9/1976 | Saleeby | 242/18 PW |
| 3,999,716 | 12/1976 | Spaller, Jr. | 242/18 PW |
| 4,002,305 | 1/1977 | Takeuchi et al. | 242/18 PW |
| 4,002,307 | 1/1977 | Turk et al. | 242/18 PW X |

FOREIGN PATENT DOCUMENTS

| | | | |
|---|---|---|---|
| 704,376 | 2/1954 | United Kingdom | 242/18 PW |

*Primary Examiner*—Stanley N. Gilreath

[57] ABSTRACT

An improved yarn supply package having a yarn package holder with first and second end portions a first yarn waste bunch wound on the package holder adjacent the first end portion, a second yarn waste bunch connected to the first waste bunch and wound on the package holder intermediate the first waste bunch and the second end portion of the package holder, and a main yarn package wound on the package holder a distance from the second yarn waste bunch and connected thereto by a transfer tail. Also disclosed is a method of producing the improved yarn supply package as well as a pneumatic cylinder-actuated yarn tailing mechanism and a pneumatic control system for the automatic control of the operation of the tailing mechanism.

10 Claims, 4 Drawing Figures

YARN SUPPLY PACKAGE AND METHOD AND APPARATUS FOR THE WINDING THEREOF

The present invention relates generally to winding of yarn supply packages.

When producing melt spun yarns such as polyester, nylon, polypropylene, or other fibers, it is necessary to produce transfer tails at the beginning of supply package winding to facilitate the future use of the yarn. The conventional method of transfer tail formation requires that the tail be dressed, that is, cleaned up and the end taped to the package. This is a time consuming process, and in its performance there is the chance of damaging the yarn, for example, placing the tape across more than one wrap of the transfer tail. Also, the tail is allowed to become slack during the cleanup operation, and this can allow the tail to lose coherency which can alter the physical characteristics of the yarn resulting in undesirable characteristics in the yarn such as inconsistent dye absorption capability or inconsistent results during texturing processing.

It is simple and well known to produce a yarn waste bunch on the conventional plastic start-up insert in the outer end of a package holder bobbin. However, if the single waste bunch is formed on the start-up insert, the transfer tail must run across the area of contact between the starting land of the drive roll and the bobbin, thus resulting in cutting of the transfer tail through friction between the drive roll and the package. This then results in the transfer tail becoming loose and the transfer tail may then be destroyed during the remainder of the winding process.

One object of the present invention is to provide an improved yarn supply package.

Another object of the present invention is to provide a new method for producing a yarn supply package.

A further object of the present invention is to provide new apparatus for winding an improved yarn supply package.

These and other objects, advantages, details and embodiments of the present invention will become apparent to one skilled in the art from the following detailed description and accompanying drawings of the invention as well as the appended claims.

In accordance with the present invention I have discovered that by forming two waste bunches of yarn on the bobbin there is provided an improved yarn supply package.

More specifically in the present invention there is provided an improved yarn supply package which includes a rotatable yarn package holder having first and second end portions for receiving yarn wound thereon. A first waste bunch of yarn is wound on the yarn package holder adjacent the first end portion thereof. The second waste bunch of yarn, connected to the first waste bunch, is wound on the yarn package holder intermediate the first waste bunch and the second end portion of the yarn package holder with the second waste bunch being spaced a distance from the first waste bunch. A main yarn package is connected to the second waste bunch via a transfer tail and is wound on the yarn package holder intermediate the second waste bunch and the second end portion of the yarn package holder with the main yarn package being spaced a distance from the second waste bunch. In another aspect, there is provided in the present invention a novel method of forming an improved yarn supply package. In yet another aspect, provision is made in the present invention of novel apparatus for winding an improved yarn supply package.

The present invention is illustrated in the accompanying drawings in which.

Figure 1:
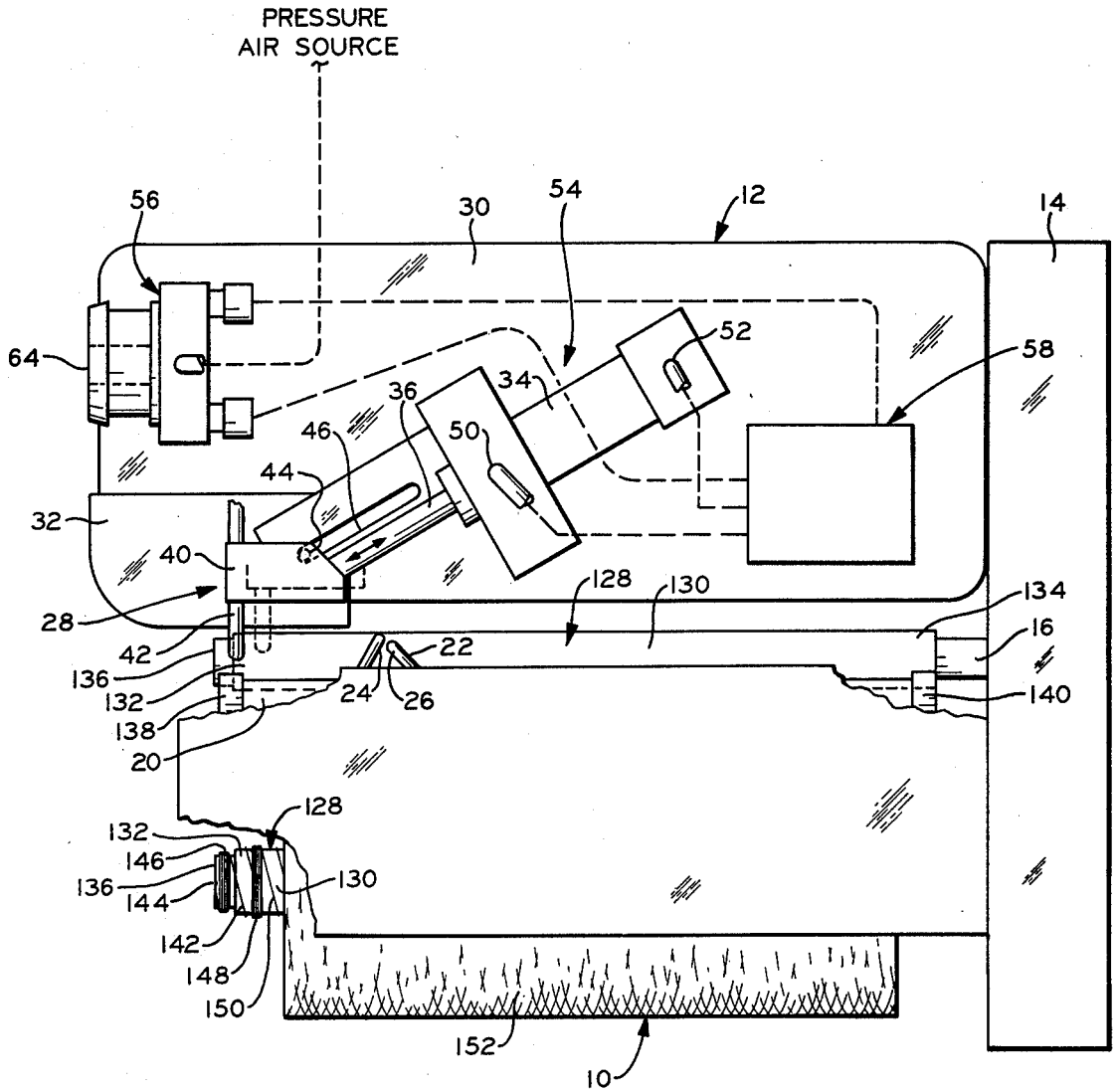
FIG. 1 is a top plan view of the yarn winder constructed in accordance with the present invention.

Referring now to the drawings, the improved yarn supply package of the present invention is generally designated by the reference character 10. The yarn supply package 10 is formed on an improved yarn winder which is generally designated by the reference character 12.

The winder 12 comprises a substantially vertically oriented supporting member 14 from which at least one horizontally oriented, rotatable chuck 16 extends. In the winder illustrated herein, a pair of chucks are journaled on a turret 18 which is, in turn, journaled on the supporting member 14 and adapted to rotate about a substantially horizontal axis. A drive roll 20 is also journaled on the supporting member 14 and is adapted to rotate about a horizontal axis parallel to the rotational axes of the chucks 16. The drive roll 20 is driven in a clockwise direction as viewed in FIG. 2 by conventional drive means (not shown) at a predetermined rotational speed. A conventional yarn traverse mechanism 22 having a pair of converging yarn engaging fingers 24 and 26 is supported by and extends outwardly from the supporting member 14 and is adapted for horizontal reciprocating movement along a line parallel to the axis of rotation of the chucks 16 whereby yarn running vertically between the fingers 24 and 26 is traversed during the winding of the main yarn package in a conventional manner as will be described more fully hereinafter.

A yarn tailing assembly 28 is mounted on a supporting base 30 which extends horizontally outwardly from the supporting member 14 to which it can be fixedly secured for cantilevered support. A yarn guide plate 32 is mounted on the supporting base 30 remote from the supporting member 14 and proximate to the drive roll 20.

A two-way pneumatic cylinder 34 is mounted on the supporting base 30. The longitudinal axis of the cylinder 34 lies in a vertical plane which intersects the vertical plane of the rotational axis of the chuck 16 at an angle of less than 90°. A rod 36 extends from the rod end 38 of the pneumatic cylinder 34 and is fixedly secured at the outer end thereof to a tailing pin head 40 in which a tailing pin 42 is mounted. A guide pin 44 extends downwardly from the tailing pin head 40 and is slidably received in a corresponding longitudinal guide slot 46 formed in a guide plate 48 mounted on the supporting base 30. The motion of the guide pin 44 within the guide slot 46 during reciprocation of the rod 36 of the pneumatic cylinder 34 provides precise guidance of the tailing pin 42 during such motion imparted by the pneumatic cylinder 34.

The two-way pneumatic cylinder 34 further includes a rod end port 50 and a piston end port 52. The operation of the pneumatic cylinder 34 is controlled by a pneumatic control assembly 54 mounted on the supporting base 30 and comprising a manually operated control valve subassembly 56 and a flow restrictor and timer valve subassembly 58.

Figure 4:
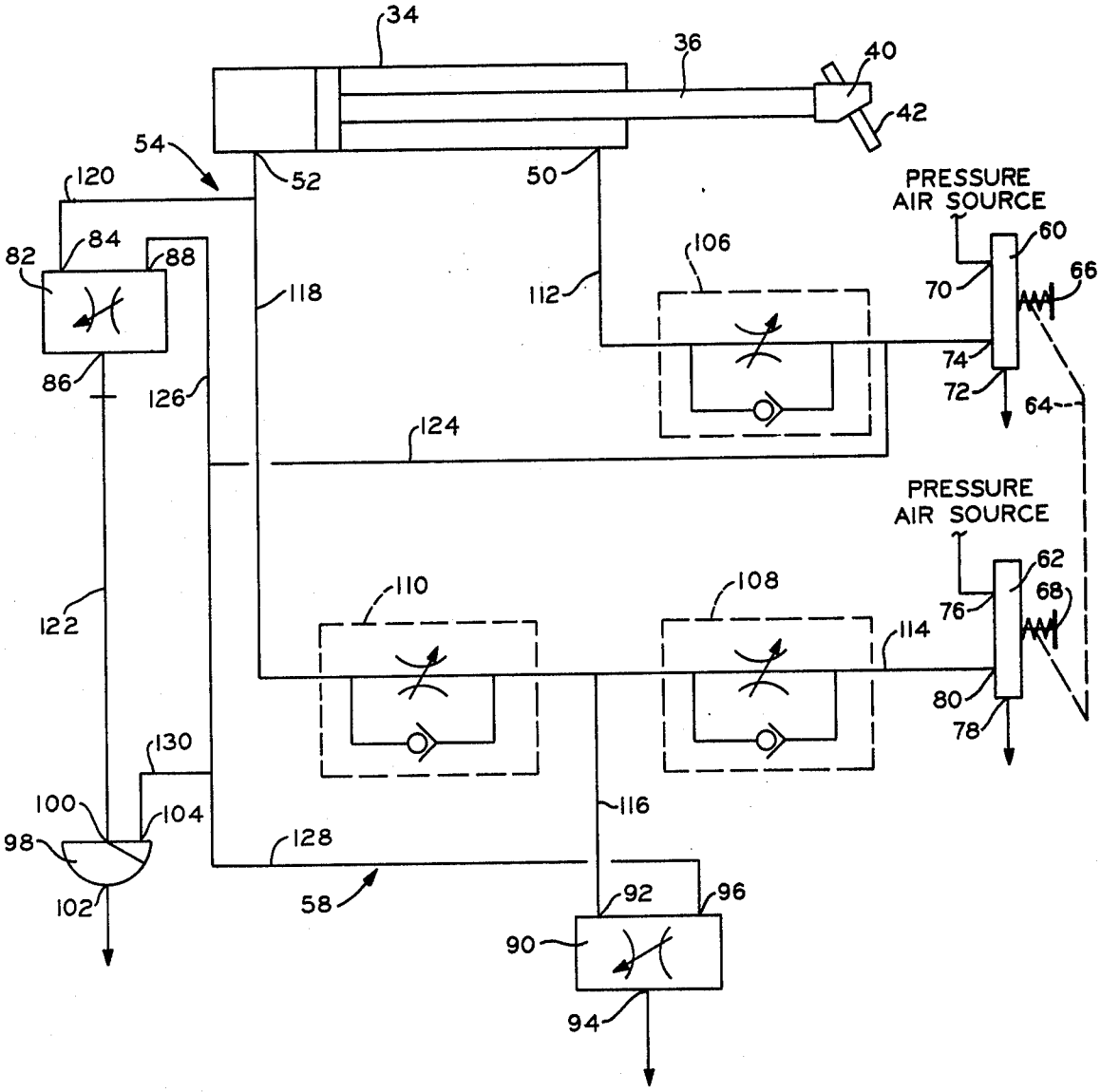
FIG. 4 is a schematic diagram illustrating the pneumatic control assembly and the pneumatic cylinder of the present invention.

The pneumatic control assembly 54 is schematically illustrated in FIG. 4. The control valve subassembly 56 comprises a normally open pneumatic control valve 60, a normally closed pneumatic control valve 62 and a ganging mechanism 64 for interengaging the operating push buttons 66 and 68 of the respective control valves 60 and 62.

The normally open control valve 60 includes a pressure port 70 connected to a suitable source of pressure air, a vent port 72 vented to the atmosphere, and an output port 74. Similarly, the normally closed control valve 62 includes a pressure port 76 also connected to a suitable source of pressure air, a vent port 78 vented to the atmosphere, and an output port 80.

The flow restrictor and timer valve subassembly 58 includes a normally open pneumatic timer valve 82 having a pressure port 84, an output port 86 and a signal port 88; a normally closed pneumatic timer valve 90 having a pressure port 92, an output port 94 vented to the atmosphere and a signal port 96; and a pneumatic pilot operated valve or "yes" element 98 having a pressure port 100, an output port 102 vented to the atmosphere and a signal port 104.

The flow restrictor and timer valve subassembly 58 further includes first, second and third unidirectional flow restrictors 106, 108 and 110. The flow restrictor 106 is interposed in a conduit 112 which communicates between the output port 74 of the normally open control valve 60 and the rod end port 50 of the two-way pneumatic cylinder 34. The flow restrictor 108 is interposed in a conduit 114 which communicates between the output port 80 of the normally closed control valve 62 and a conduit 116 which in turn communicates with the pressure port 92 of the normally closed timer valve 90. The flow restrictor 110 is interposed in a conduit 118 which communicates between the pressure port 92 of the timer valve 90 via the conduit 116 and both the pressure port 84 of the normally open timer valve 82 via a conduit 120 and the piston end port 52 of the pneumatic cylinder 34. A conduit 122 provides communication between the output port 86 of the normally open timer valve 82 and the pressure port 100 of the pilot operated valve 98. Conduits 124, 126, 128 and 130 provide communication between the output port 74 of the control valve 60 via conduit 112, the signal port 88 of the timer valve 82, the signal port 96 of the timer valve 90, and the signal port 104 of the pilot operated valve 98.

Referring again to FIGS. 1 and 2, a yarn package holder 128 is shown mounted on one rotatable chuck 16. The yarn package holder comprises a tubular bobbin 130 having a first end portion 132 and a second end portion 134. A removable start-up insert 136 is snuggly received within the open first end portion 132 of the bobbin 130.

The drive roll 20 is provided with first and second circumferential starting lands 138 and 140 formed on the first and second end portions thereof and adapted to provide rolling contact with the corresponding first and second end portions 132 and 134 of the bobbin 130 during the initial yarn winding operations in the production of a yarn supply package 10. A completed yarn supply package 10 in position for doffing is shown mounted on a second rotatable chuck carried by the turret 18.

Figures 2, 3:
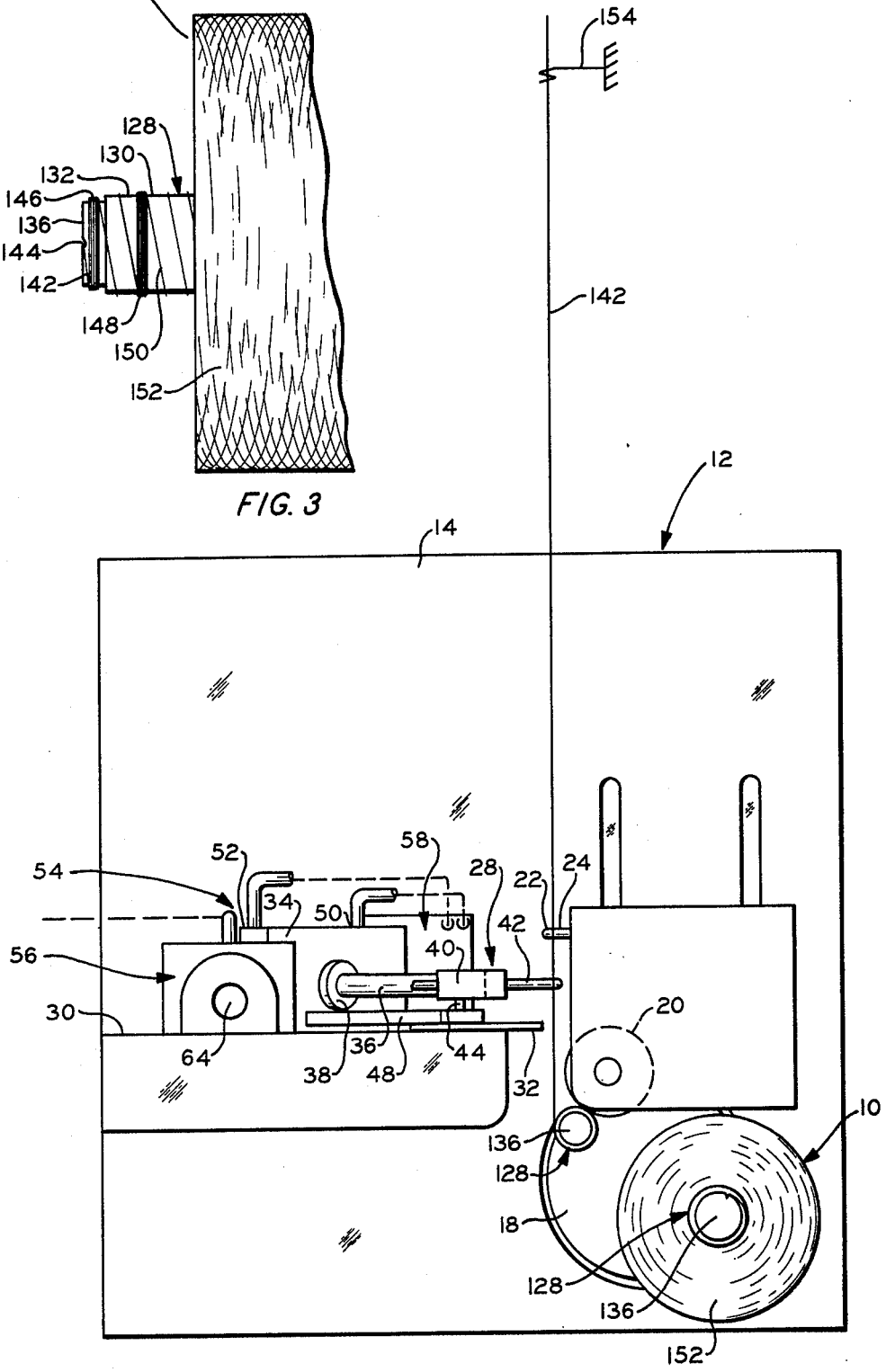
FIG. 2 is a side elevation view of the yarn winder of FIG. 1 as viewed from the left in FIG. 1.
FIG. 3 is an enlarged, partial elevation view of one end of a yarn supply package constructed in accordance with the present invention and illustrating the positions of the yarn waste bunches and transfer tail thereof.

FIG. 3 illustrates the starting end portion of a completed yarn supply package 10. The yarn 142 is initially engaged in a notch 144 or the like formed on the outer periphery of the removable start-up insert 136 and is then wound in a first yarn waste bunch 146 comprising a plurality of wraps of yarn about the cylindrical outer periphery of the start-up insert. From the first yarn waste bunch, the yarn 142 is traversed from left to right form the start-up insert 136 onto the first end portion 132 of the bobbin 130 where a second yarn waste bunch 148 is wound on the bobbin 130 in the form of a plurality of yarn wraps. From the second yarn waste bunch 148, the yarn 142 is traversed from left to right as viewed in FIG. 3 to form a transfer tail 150 which is locked to the bobbin 130 by the second yarn waste bunch 148. The transfer tail 150 tails into the main yarn package 152 which is formed on the bobbin 130 in a conventional manner through the reciprocating action of the yarn traverse mechanism 22.

The formation of the first and second waste bunches 146 and 148, the transfer tail 150 and the main yarn package 152 is achieved in the following manner. As each new yarn supply package is prepared for formation, an empty yarn package holder 128 is installed on a rotatable chuck 16. The yarn package holder and chuck are then rotated together by means of the rotating drive roll 20 which rollingly engages the first and second end portions 132 and 134 of the bobbin 130 with the first and second starting lands 138 and 140 of the drive roll.

The running yarn 142 is directed downwardly through a yarn guide 154 toward the yarn winder 12 positioned therebeneath. Initially, the pneumatic control assembly 54 is at rest and the two-way pneumatic cylinder 34 is in its retracted position. The operator then simultaneously depresses the ganged push buttons 66 and 68 of the control valves 60 and 62 and maintains the push buttons in the depressed position causing the normally open control valve 60 to vent conduits 112, 124, 126, 128 and 130 thus opening the normally open pneumatic timer valve 82 and simultaneously opening the normally closed control valve 62 so that the pneumatic cylinder 34 is pressurized through the piston end port 52 via conduits 114 and 118 and the check valves of the flow restrictors 108 and 110, and the rod end port 50 is vented via conduit 112 and the control valve 60. Air does not flow through the normally open pneumatic timer valve 82 at this time because the pilot operated valve 98 or "yes" element is closed since its signal port 104 is vented via conduits 130, 128, 124 and 112 and the control valve 60.

While maintaining the push buttons 66 and 68 in their depressed positions, the operator engages the running yarn 142 in the notch 144 of the start-up insert 136 of the rotating yarn package holder 128 and winds the first yarn waste bunch 146 on the start-up insert. The running yarn 142 engages the tailing pin 42 on the extended rod 36 to maintain the running yarn in position to generate the first yarn waste bunch 146 on the yarn package holder 128.

When a sufficient quantity of yarn is wound on the yarn package holder to generate a satisfactory first waste bunch, the operator releases the ganged push buttons 66 and 68 thereby opening the normally open control valve 60 and closing the normally closed control valve 62. By opening the control valve 60, pressure air is applied therethrough to the rod end port 50 of the pneumatic cylinder 34 and to the signal ports 88, 96 and 104 of the normally open pneumatic timer valve 82, normally closed pneumatic timer valve 90 and pilot operated valve 98, respectively. The application of a pressure air signal to the signal port of the pilot operated valve or "yes" element 98 causes the "yes" element to open permitting flow therethrough to the atmosphere from the piston end port 52 of the pneumatic cylinder 34 via conduits 118 and 120, pneumatic timer valve 82 and conduit 122, thereby allowing the rod 36 of the pneumatic cylinder 34 to retract and move the tailing pin 42 quickly across the area of engagement between the first starting land 138 of the drive roll 20 and the bobbin 130 of the yarn package holder 128 and then come to a nearly complete stop as the timer valve 82 closes after a predetermined delay in response to the application of the pressure air signal to the signal port 88 thereof. This action results in positioning the running yarn 142 on the first end portion of the bobbin to form the second yarn waste bunch 142 on the bobbin adjacent to but out of contact with the area of engagement between the first end portion 132 of the bobbin 130 and the starting land 138 of the drive roll 20. This position of the tailing pin 42 and tailing pin head is illustrated by dashed lines in FIG. 1.

During the winding of the second yarn waste bunch 148, the rod 36 of the pneumatic cylinder 34 moves slowly for approximately 0.1–0.2 seconds since the air exhausted from the piston end port 52 of the pneumatic cylinder 34 flows through both restrictors 108 and 110 and conduits 114 and 118 into the output port 80 and out the vent port 78 of the closed control valve 62. After a predetermined time commencing with the application of the pressure air signal to the signal port 96 of the pneumatic timer valve 90, the valve 90 automatically opens between the restrictors 108 and 110, and the speed of retraction of the rod 36 increases thereby tailing away until the yarn traverse mechanism 22 picks up the running yarn 142.

As the rod 36 and the tailing pin 42 tail away upon the opening of the pneumatic timer valve 90, the running yarn 142 remains in contact with the edge of the tailing pin 42 thereby generating the transfer tail 150 on the bobbin 130 intermediate the second yarn waste bunch 148 and the main yarn package 152. The second yarn waste bunch 148 locks in the transfer tail 150 thereby protecting the transfer tail from damage during the winding process in the event the yarn is cut by friction between the starting land 138 and the first end portion 132 of the bobbin 130 as the yarn runs from the first yarn waste bunch 146 on the start-up insert 136 onto the bobbin 128. This is an important feature of the present invention since a loose transfer tail can be destroyed during the remainder of the winding process.

Reasonable variations and modifications which will be apparent to those skilled in the art can be made in this invention without departing from the spirit and scope thereof.

I claim:

1. An improved yarn supply package comprising:

rotatable yarn package holder means having first and second end portions for receiving yarn wound thereon;

a first waste bunch of yarn wound on said yarn package holder means adjacent the first end portion thereof;

a second waste bunch of said yarn connected to said first waste bunch and wound on said yarn package holder means intermediate said first waste bunch and the second end portion of said yarn package holder means, said second waste bunch being spaced a distance from said first waste bunch; and a main yarn package of said yarn connected to said second waste bunch via a transfer tail of said yarn and wound on said yarn package holder means intermediate said second waste bunch and the second end portion of said yarn package holder means, said main yarn package being spaced a distance from said second waste bunch.

2. The yarn supply package as defined in claim 1 wherein said yarn package holder means is characterized further to include:

a yarn package holder assembly having first and second end portions and including bobbin means for receiving said second waste bunch of yarn, said transfer tail and said main yarn package thereon, the first end portion of said yarn package holder assembly including removable start-up insert means for receiving said first waste bunch of said yarn wound thereon and means for removably securing said start-up insert means to said bobbin means.

3. The yarn supply package as defined in claim 1 wherein said yarn package holder means is characterized further to include:

a bobbin having first and second end portions;

start-up insert means positioned at the first end portion of said bobbin for receiving said first waste bunch of yarn wound thereon;

means for securing said insert means to said bobbin whereby said insert means rotates therewith, and, alternately, for releasing said insert means from said bobbin; and said first waste bunch of yarn being wound on said insert means and said second waste bunch of yarn being wound on the first end portion of said bobbin proximate to said insert means when said bobbin and said insert means are secured together.

4. A method of producing a package of yarn on a yarn package holder assembly comprising a bobbin having first and second end portions and a removable start-up insert mounted on the first end portion thereof, said method comprising the steps of:

rotating a yarn package holder assembly;

engaging a running yarn on the start-up insert of the rotating yarn package holder assembly;

winding said running yarn on the rotating start-up insert to form a first yarn waste bunch thereon;

moving said running yarn from the first yarn waste bunch to the first end portion of the bobbin;

winding said running yarn on the first end portion of the rotating bobbin to form a second yarn waste bunch thereon;

moving said running yarn from the second waste bunch along the rotating bobbin to form a transfer tail on the bobbin; and winding and traversing said running yarn on the rotating bobbin intermediate said transfer tail and the second end portion of the bobbin to form a main yarn package thereon.

5. A method of producing a package of yarn having first and second yarn waste bunches, a main yarn package and a transfer tail on a winder, wherein the winder includes chuck means for rotatably supporting at least one yarn package holder assembly comprising a bobbin having first and second end portions and a removable start-up insert mounted on the first end portion thereof, drive roll means having first and second end portions with first and second starting lands formed respectively thereon each having a diameter greater than the diameter of the medial portion of the drive roll means intermediate said starting lands for rotating a yarn package holder assembly, yarn traversing means for engaging and traversing a runninng yarn during winding thereof upon a yarn package holder assembly, yarn tailing means for engaging a running yarn and positioning said yarn relative to a rotating yarn package holder assembly, said method comprising the steps of:

rotating a yarn package holder on the winder;

engaging a running yarn on the start-up insert of the rotating yarn package holder assembly;

winding said running yarn on the start-up insert to form a first yarn waste bunch thereon;

moving said running yarn from the first yarn waste bunch on the start-up insert across the area of contact between the first end portion of the bobbin and the starting land on the first end portion of the drive roll means;

winding said running yarn on the first end portion of the bobbin to form a second yarn waste bunch thereon out of contact with the area of engagement between the first end portion of the bobbin and the starting land on the first end portion of the drive roll means;

moving said running yarn from the second waste bunch on the bobbin into engagement with the yarn traversing means to form a yarn transfer tail on the bobbin; and winding and traversing said running yarn on the bobbin to form a main yarn package thereon interconnected with said second yarn waste bunch via the transfer tail.

6. In a continuous delivery yarn winding device of the type which includes chuck means for rotatably supporting at least one yarn package holder, drive roll means for rotating a yarn package holder supported by said chuck means, and yarn traversing means for traversing a running yarn during the winding thereof upon a yarn package holder to form a main yarn package, the improvement comprising:

yarn tailing means for engaging a running yarn and positioning said yarn relative to a rotating yarn package holder;

yarn engaging means on a first end portion of said yarn package holder for engaging said running yarn whereby said yarn is initially wound about said yarn engaging means adjacent the first end portion of said rotating package holder;

control means operatively connected to said yarn tailing means for positioning said yarn tailing means in first position relative to the rotating yarn package holder in response to a first signal applied thereto whereby said running yarn is aligned with said yarn engaging means to form a first waste bunch of yarn thereon, for automatically moving said yarn tailing means to a second position from said first position relative to the rotating yarn package holder and automatically stopping said yarn tailing means at said second position for a predetermined time period in response to a second signal applied thereto whereby said running yarn is positioned to form a second waste bunch of yarn wound on the rotating yarn package holder a distance from said first waste bunch, and for automatically moving said tailing means from said second position to a third position upon the expiration of said predetermined time period whereby said running yarn forms a transfer tail on said rotating yarn package holder during said movement to the third position and whereby the running yarn is so positioned as to be engaged by said traversing means for traversing said running yarn along said rotating yarn package holder to form a main yarn package and said tailing means is disengaged from said running yarn.

7. The continuous delivery yarn winding device as defined in claim 6 wherein said yarn tailing means is characterized further to include:

power cylinder means having a piston rod extending therefrom and positioned adjacent said chuck means for extending and retracting said piston rod in response to said control means;

means for mounting said power cylinder means and said chuck means in relatively fixed positional relation; and tailing pin means carried by said piston rod for engaging running yarn moving therepast and positioning said yarn along a rotating yarn package holder in response to extension and, alternately, retraction of said power cylinder means.

8. The continuous delivery yarn winding device as defined in claim 7 wherein the axis of rotation of the rotating yarn package holder and the longitudinal axis of the piston rod of said power cylinder means lie in mutually intersecting vertical planes, said planes intersecting at an included angle of less than 90°.

9. The continuous delivery yarn winding device as defined in claim 7 wherein:

said power cylinder is a two-way pneumatic cylinder having a rod end port and a piston end port; and said control means is a pneumatic control system comprising:

normally open control valve means having a pressure port, an output port and a vent port for normally communicating the pressure port and output port thereof in a first position and, alternately, communicating the output port and vent port thereof in a second position in response to an external signal applied thereto;

normally closed control valve means having a pressure port an output port and a vent port for normally communicating the output port and the vent port thereof in a first position and, alternately, communicating the pressure port and output port thereof in a second position in response to an external signal applied thereto;

normally open timer valve means having a pressure port, an output port and a signal port for blocking communication between the pressure port and output port thereof with a predetermined time delay in the presence of a signal pressure at the signal port and, alternately, for rapidly communicating the pressure port and the output thereof in the absence of a signal pressure at the signal port thereof;

normally closed timer valve means having a pressure port, an output port and a signal port for communicating the pressure port and the output port thereof with a predetermined time delay in the presence of a signal pressure at the signal port thereof and, alternately, for rapidly blocking such communication in the absence of a signal pressure at the signal port thereof;

pilot operated valve means having a pressure port, a signal port and an output port for communicating the pressure port and the output port thereof in the presence of a signal pressure at the signal port thereof and, alternately, for blocking such communication in the absence of a signal pressure at the signal port thereof;

first conduit means for providing communication between the output port of said normally open control valve means and the rod end port of said pneumatic cylinder;

first unidirectional flow restrictor means interposed in said first conduit means for providing a restricted flow path therethrough from the rod end port of said pneumatic cylinder to the output port of said normally open control valve means and, alternately, for providing a substantially unrestricted flow path therethrough from the output port of said normally open control valve means to the rod end port of said pneumatic cylinder;

second conduit means for providing communication between the output port of said normally closed control valve means and the pressure port of said normally closed timer valve means;

second unidirectional flow restrictor means interposed in said second conduit means for providing a restricted flow path therethrough from the pressure port of said normally closed timer valve means to the output port of said normally closed control valve means and, alternately, for providing a substantially unrestricted flow path therethrough from the output port of said normally closed control valve means to the pressure port of said normally closed timer valve means;

third conduit means for providing communication between the pressure port of said normally closed timer valve means and both the piston end port of said pneumatic cylinder and the pressure port of said normally open timer valve means;

third unidirectional flow restrictor means interposed in said third conduit means for providing a restricted flow path therethrough from the pressure port of said normally open timer valve means and the piston end port of said pneumatic cylinder to the pressure port of said normally closed timer valve means and, alternately, for providing a substantially unrestricted flow path therethrough from the pressure port of said normally closed timer valve means to both the piston end port of said pneumatic cylinder and the pressure port of said normally open timer valve means;

fourth conduit means for providing communication between the output port of said normally open timer valve means and the pressure port of said pilot operated valve means; and fifth conduit means for providing communication between the output port of said normally open control valve means and the respective signal ports of said normally open timer valve means, said pilot operated valve means and said normally closed timer valve means.

10. The continuous delivery yarn winding device as defined in claim 9 characterized further to include:

means operatively linking said normally open control valve means and said normally closed control valve means for simultaneously moving said control valves from their first positions to their second positions in response to a single external signal applied thereto.

* * * * *

UNITED STATES PATENT AND TRADEMARK OFFICE

CERTIFICATE OF CORRECTION

PATENT NO. : 4,102,508

DATED : July 25, 1978

INVENTOR(S) : Albert F. Stegelman

It is certified that error appears in the above-identified patent and that said Letters Patent are hereby corrected as shown below:

Column 8, claim 9, line 60, after "output" the word "port" should be inserted.

Signed and Sealed this

*Tenth* Day of *March 1981*

[SEAL]

*Attest:*

RENE D. TEGTMEYER

*Attesting Officer* *Acting Commissioner of Patents and Trademarks*